US012590358B2

(12) United States Patent
Lee

(10) Patent No.: US 12,590,358 B2
(45) Date of Patent: Mar. 31, 2026

(54) NON-ORIENTED ELECTRICAL STEEL SHEET AND MANUFACTURING METHOD THEREFOR

(71) Applicant: POSCO, Pohang-si (KR)

(72) Inventor: Seil Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 895 days.

(21) Appl. No.: 17/280,482

(22) PCT Filed: Sep. 25, 2019

(86) PCT No.: PCT/KR2019/012473
§ 371 (c)(1),
(2) Date: Apr. 29, 2021

(87) PCT Pub. No.: WO2020/067723
PCT Pub. Date: Apr. 2, 2020

(65) Prior Publication Data

US 2021/0340651 A1 Nov. 4, 2021

(30) Foreign Application Priority Data

Sep. 27, 2018 (KR) ..... 10-2018-0115273

(51) Int. Cl.

| | |
|---|---|
| ***C22C 38/14*** | (2006.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/14* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01)

(58) Field of Classification Search
None
See application file for complete search history.

(56) References Cited

U.S. PATENT DOCUMENTS

| | | | |
|---|---|---|---|
| 6,524,380 | B1 | 2/2003 | Briles et al. |
| 2016/0042850 | A1 | 2/2016 | Oda et al. |
| 2018/0030558 | A1 | 2/2018 | Okubo et al. |

FOREIGN PATENT DOCUMENTS

| | | | |
|---|---|---|---|
| CN | 104674136 | A | 6/2015 |
| CN | 104722726 | A | 6/2015 |
| CN | 108474055 | A | 8/2018 |
| JP | 2005-290514 | A | 10/2005 |
| JP | 2013-044010 | A | 3/2013 |
| JP | 2014-091850 | A | 5/2014 |
| JP | 2014-196538 | A | 10/2014 |
| JP | 2016-199787 | A | 12/2016 |
| JP | 2017-128801 | A | 7/2017 |
| JP | 6319586 | B2 | 4/2018 |
| KR | 10-2005-0018677 | A | 2/2005 |
| KR | 10-2015-0119229 | A | 10/2015 |
| KR | 10-1728028 | B1 | 4/2017 |
| KR | 10-1797334 | B1 | 11/2017 |
| KR | 10-2018-0070951 | A | 6/2018 |
| KR | 10-2018-0087374 | A | 8/2018 |
| WO | 2017/111554 | A1 | 6/2017 |
| WO | 2017/115657 | A1 | 7/2017 |
| WO | 2018/131712 | A1 | 7/2018 |

OTHER PUBLICATIONS

English language machine translation of JP2017128801A. Generated May 1, 2024. (Year: 2024).*
Extended European Search Report dated Aug. 2, 2021 issued in European Patent Application No. 19865499.8.
International Search Report and Written Opinion issued in corresponding International Application No. PCT/KR2019/0142473 dated Jan. 15, 2020, with partial English translation.

* cited by examiner

*Primary Examiner* — Ricardo D Morales
(74) *Attorney, Agent, or Firm* — Morgan Lewis & Bockius LLP

(57) ABSTRACT

A non-oriented electrical steel sheet according to an embodiment of the present invention includes: Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, and the balance including Fe and other impurities unavoidably added thereto.

9 Claims, No Drawings

NON-ORIENTED ELECTRICAL STEEL SHEET AND MANUFACTURING METHOD THEREFOR

CROSS REFERENCE

This application is the U.S. National Phase under 35 U.S.C. § 371 of International Application No. PCT/KR2019/012473 filed on Sep. 25, 2019, which claims the benefit of Korean Patent Application No. 10-2018-0115273 filed on Sep. 27, 2018, the entire contents of each are hereby incorporated by reference.

TECHNICAL FIELD

An embodiment of the present invention relates to a non-oriented electrical steel sheet and a manufacturing method thereof. Specifically, an embodiment of the present invention relates to a non-oriented electrical steel sheet and a manufacturing method thereof in which iron loss is low and magnetic flux density is high in a low magnetic field region by adding appropriate amounts of As and Mg elements to a steel sheet and appropriately segregating As and Mg at grain boundaries.

BACKGROUND ART

A non-oriented electrical steel sheet is used as a material for an iron core in rotary devices such as motors and generators, and stationary devices such as small transformers, and plays an important role in determining energy efficiency in electric devices. The representing characteristics of the electrical steel sheet may include iron loss and magnetic flux density, wherein it is preferable that the iron loss becomes smaller and the magnetic flux density becomes higher, and this is because when a magnetic field is induced as the iron loss becomes small the energy being lost in the form of heat can be reduced, and as the magnetic flux density becomes high a larger magnetic field can be induced with the same amount of energy. Conventionally, among magnetic characteristics of the non-oriented electrical steel sheet used in a motor and the like, the iron loss is evaluated as energy loss when magnetized up to 1.5 T at a 50 Hz frequency by using W15/50 as an index, and the magnetic flux density is evaluated by a magnetic flux density of the electrical steel sheet at 5000 A/m by using B50 as an index, while in an inverter-driven AC motor, the magnetic characteristics in a low magnetic field region have also become important because the electrical steel sheet is magnetized to have a magnetic flux density of about 1.0 T.

DISCLOSURE

DESCRIPTION OF THE DRAWINGS

An embodiment of the present invention is to provide a non-oriented electrical steel sheet and a manufacturing method thereof. Specifically, a non-oriented electrical steel sheet and a manufacturing method thereof in which iron loss is low and magnetic flux density is high in a low magnetic field region by adding appropriate amounts of As and Mg elements to a steel sheet to appropriately segregate As and Mg at grain boundaries, are provided.

A non-oriented electrical steel sheet according to an embodiment of the present invention includes: Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, and the balance including Fe and other impurities unavoidably added thereto.

In the non-oriented electrical steel sheet according to the embodiment of the present invention, As may be contained in an amount of 0.0034 to 0.01 wt %.

In the non-oriented electrical steel sheet according to the embodiment of the present invention, Mg may be contained in an amount of 0.0009 to 0.002 wt %.

The non-oriented electrical steel sheet may satisfy Formula 1 below.

$$[As]>[Al] \quad \text{[Formula 1]}$$

(In Formula 1, [As] and [Al] are contents (wt %) of As and Al, respectively.)

The non-oriented electrical steel sheet may satisfy Formula 2 below.

$$3\times[Mg]>[Al] \quad \text{[Formula 2]}$$

(In Formula 2, [Mg] and [Al] are contents (wt %) of Mg and Al, respectively.)

The non-oriented electrical steel sheet may further include Sn at 0.02 to 0.15 wt % and P at 0.01 to 0.15 wt %.

The non-oriented electrical steel sheet may satisfy Formula 3 below.

$$0.03\leq[Sn]+[P]\leq0.15 \quad \text{[Formula 3]}$$

(In Formula 3, [Sn] and [P] are contents (wt %) of Sn and P, respectively.)

The non-oriented electrical steel sheet may further include C at 0.004 wt % or less, N at 0.003 wt % or less, and Ti at 0.003 wt % or less.

In the non-oriented electrical steel sheet according to the embodiment of the present invention, one or more of Cu, Ni, and Cr may be further contained in an amount of 0.05 wt % or less, respectively.

In the non-oriented electrical steel sheet according to the embodiment of the present invention, one or more of Zr, Mo, and V may be further contained in an amount of 0.01 wt % or less, respectively.

In the non-oriented electrical steel sheet according to the embodiment of the present invention, a precipitate of As may be included in a size of 0.0001 to 0.003 area %.

In the non-oriented electrical steel sheet according to the embodiment of the present invention, an average particle diameter of the precipitate of As may be 3 to 100 nm.

In the non-oriented electrical steel sheet according to the embodiment of the present invention, a precipitate of MgS may be included in a size of 0.0002 to 0.005 area %.

In the non-oriented electrical steel sheet according to the embodiment of the present invention, an average particle diameter of the precipitate of MgS may be 3 to 30 nm.

In the non-oriented electrical steel sheet according to the embodiment of the present invention, an average grain size may be 60 to 300 μm.

A manufacturing method of a non-oriented electrical steel sheet according to an embodiment of the present invention includes: heating a slab containing Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, and the balance containing Fe and inevitable impurities; hot-rolling the slab to manufacture a hot-rolled sheet; cold-rolling the hot-rolled sheet to manufacture a cold-rolled sheet, and final annealing the cold-rolled sheet.

The slab may be heated at 1100° C. to 1250° C.

The manufacturing method of the non-oriented electrical steel sheet may further include, after the manufacturing of the hot-rolled sheet, annealing the hot-rolled sheet at a temperature of 950 to 1200° C.

In the final annealing, the cold-rolled sheet may be annealed at 950 to 1150° C.

According to the embodiment of the present invention, it is possible to obtain a non-oriented electrical steel sheet having excellent magnetism by adding appropriate amounts of As and Mg elements to a steel sheet and appropriately segregating As and Mg at grain boundaries.

Particularly, according to the embodiment of the present invention, it is possible to obtain a non-oriented electrical steel sheet having low iron loss and high magnetic flux density in a low magnetic field region.

In addition, the non-oriented electrical steel sheet according to the embodiment of the present invention provides optimized characteristics to an inverter-driven AC motor.

MODE FOR INVENTION

The technical terms used herein are to simply mention a particular embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added.

When referring to a part as being "on" or "above" another part, it may be positioned directly on or above another part, or another part may be interposed therebetween. In contrast, when referring to a part being "directly above" another part, no other part is interposed therebetween.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as having idealized or very formal meanings unless defined otherwise.

Unless otherwise stated, % means % by weight, and 1 ppm is 0.0001% by weight.

In embodiments of the present invention, inclusion of additional elements in a steel component means replacing the remaining iron (Fe) by an additional amount of the additional elements.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In an embodiment of the present invention, by optimizing ranges of compositions in a non-oriented electrical steel sheet, particularly ranges of As and Mg that are main additives to appropriately segregate the As and Mg at a grain boundary, it is possible to obtain a non-oriented electrical steel sheet with low iron loss and high magnetic flux density in a low magnetic field region.

A non-oriented electrical steel sheet according to an embodiment of the present invention includes: in wt %, Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, and the balance including Fe and other impurities unavoidably added thereto.

First, the reason for limiting the components of the non-oriented electrical steel sheet will be described.

Si at 1.5 to 4.0 wt %

Silicon (Si) is a component that decreases eddy current loss of iron loss by increasing specific resistance of steel, and is a major element added to the non-oriented electrical steel sheet. When too little Si is added, it is difficult to obtain a low iron loss characteristic, and annealing at 1000° C. or higher may cause phase transformation. When too much Si is added, rollability may deteriorate. Therefore, in the embodiment of the present invention, an addition amount of Si is limited to 1.5 to 4.0 wt %. More specifically, the addition amount of Si may be 2.0 to 3.5 wt %.

Al at 0.001 to 0.011 wt %

Aluminum (Al) is an element that is inevitably added for deoxidation of steel in a steelmaking process. In a general steelmaking process, 0.001 wt % or more of Al exists in the steel. However, when Al is excessively added, since it reduces a saturation magnetic flux density and forms fine AlN to suppress grain growth and ultimately deteriorate magnetism, an addition amount of Al is limited to 0.001 to 0.011 wt % in the embodiment of the present invention. More specifically, the addition amount of Al may be 0.0015 to 0.005 wt %.

Mn at 0.05 to 0.40 wt %

Since manganese (Mn) has an effect of lowering iron loss by increasing specific resistance along with Si and Al, although the iron loss is improved by adding a large amount of Mn in a conventional technology, a saturation magnetic flux density decreases as an addition amount of Mn increases, so that the magnetic flux density when a constant current is applied decreases. In addition, since Mn is an element that forms a strong sulfide, when a large amount of Mn is added, the effect of Mg and As to be utilized in the embodiment of the present invention is reduced. Therefore, in the embodiment of the present invention, in order to improve the magnetic flux density and prevent an increase in iron loss due to inclusions, the addition amount of Mn is limited to 0.05 to 0.40 wt %. More specifically, Mn may be added in an amount of 0.05 to 0.30 wt %.

S at 0.0001 to 0.01 wt %

Sulfur (5) is an element that forms sulfides such as MnS, CuS, and (Cu,Mn)S, which are harmful to magnetic characteristics, so it is known that it is desirable to add it small to suppress an increase in iron loss. However, when S is segregated on a surface of the steel, it has an effect of lowering surface energy of a {100} plane, so a strong texture of the {100} plane that is advantageous for magnetism may be obtained by adding S. Particularly, since an amount of S reacting with Mg and As is proportional to the number of entire atoms of Mg and As, its addition range must be determined so as to provide sufficient atoms to form sulfides by bonding with Mg and As. However, when it is excessively added, processability is greatly deteriorated by segregation at grain boundaries, and problems due to surface segregation may occur. Therefore, in the embodiment of the present invention, the addition amount of S is limited to 0.0001 to 0.01 wt %. More specifically, S may be added in an amount of 0.0005 to 0.005 wt %.

As at 0.003 to 0.015 wt %

Arsenic (As) is used as a grain boundary segregation element in the embodiment of the present invention. Accordingly, an amount of segregation is determined through competition with other segregation elements in the steel such as P, Sn, and S. Segregation by P or S may deteriorate strength of the grain boundaries to significantly deteriorate processability in a range from the room temperature to 900° C. Therefore, the addition amount thereof is preferably 0.003 wt % or more from the viewpoint of processability. When added in excess, the addition amount thereof is limited because it may interfere with the segregation effect of P and S, which helps to form the {100} plane. Specifically, As may be contained in an amount of 0.0034 to 0.01 wt %.

Mg at 0.0007 to 0.003 wt %

In the embodiment of the present invention, magnesium (Mg) is combined with S during continuous casting to form MgS, thereby slowing a crystal growth speed of the hot-rolled sheet. In addition, in the manufacturing process of the electrical steel sheet, the effect of slowing the crystal growth speed does not appear in the final annealing because it is combined with MnS and the like to become coarse. However, when it is added in excess, an effect of controlling a texture during annealing by P may be suppressed. In this case, according to an appropriate addition range of Mg, it may be expected to coarsen the sulfide to promote particle growth. Therefore, in the embodiment of the present invention, an addition amount of Mg is limited to 0.0007 to 0.003 wt %. More specifically, the addition amount of Mg may be 0.0009 to 0.002 wt %.

The non-oriented electrical steel sheet according to the embodiment of the present invention may satisfy Formula 1 below.

$$[As]>[Al] \quad \text{[Formula 1]}$$

(In Formula 1, [As] and [Al] are contents (wt %) of As and Al, respectively.)

Al is an element forming a nitride, however, when the nitride is formed in steel, it acts to be very disadvantageous for crystal growth. Particularly, crystal growth is hindered by Al formed at the grain boundaries. In this case, when As that is a grain boundary segregation element, exists in the grain boundaries, Al is not finely precipitate at the grain boundaries, so the crystal growth is not hindered. Therefore, in the embodiment of the present invention, a relationship between As and Al is adjusted as shown in Formula 1.

The non-oriented electrical steel sheet according to the embodiment of the present invention may satisfy Formula 2 below.

$$3\times[Mg]>[Al] \quad \text{[Formula 2]}$$

(In Formula 2, [Mg] and [Al] are contents (wt %) of Mg and Al, respectively.)

In the case of Mg that forms sulfides, since S is an element that is segregated at the grain boundaries, it combines with S to form sulfides to settle in the grain boundaries. Accordingly, a nitride by Al is not formed at the grain boundaries during hot-rolling. MgS becomes (Mn, Mg)S as Mn and S are combined therewith in the manufacturing process of the electrical steel sheet, resulting in coarsening, and thus, the effect of suppressing crystal growth is weakened. In order to provide this effect, Mg should be more than ⅓ of Al.

The non-oriented electrical steel sheet according to the embodiment of the present invention may further include Sn at 0.02 to 0.09 wt % and P at 0.01 to 0.15 wt %. As described above, when the additional elements are further contained, they replace the balance of Fe. That is, in wt %, Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, Sn at 0.02 to 0.09 wt %, and P at 0.01 to 0.15 wt % are included, and the balance includes Fe and inevitable impurities.

Sn at 0.02 to 0.09 wt %

Tin (Sn) is segregated on the surface and grain boundaries of the steel sheet, suppresses surface oxidation during annealing, and improves the texture. When too little Sn is added, an effect thereof may not be sufficient. When too much Sn is added, it is not preferable because it is segregated at the grain boundaries to degrade toughness to degrade productivity with respect to the magnetism improvement. Therefore, when Sn is further added, it may be added in a range of 0.02 to 0.09 wt %. More specifically, Sn may be contained in an amount of 0.03 to 0.07 wt %.

P at 0.01 to 0.15 wt %

P increases resistivity to reduce iron loss, and is segregated at the grain boundaries, so that it prevents the formation of a texture {111} that is harmful to magnetism and forms a texture {100} that is useful for magnetism. However, when too much P is added, it degrades rollability. In addition, when P is additionally added, the content P is further more contained as an element that lowers the surface energy of the {100} plane in the sheet surface of the steel, thereby increasing the amount of P that is segregated on the surface, and accordingly, it is possible to further lower the surface energy of the {100} plane, which is advantageous for magnetism, to improve the growth rate of grains having the {100} plane, which is advantageous for magnetism during annealing. Therefore, in the embodiment of the present invention, P may be added in an amount of 0.01 to 0.15 wt %. More specifically, P may be included in an amount of 0.02 to 0.1 wt %.

The non-oriented electrical steel sheet according to the embodiment of the present invention may satisfy Formula 3 below.

$$0.03\leq[Sn]+[P]\leq0.15 \quad \text{[Formula 3]}$$

Sn and P are grain boundary segregation elements, and when they are not segregated at the grain boundaries, too many fine precipitates are formed at the grain boundaries, so that crystal growth and magnetic flux density improvement may be expected through control of As segregation or precipitates such as (Mg, Mn)S, AlN, etc. Therefore, when Sn and P are further added, it is preferable to add 0.03 wt % or more of Sn and P in a total amount. However, when too much Sn and P are added, various defects are caused on the surface of the steel sheet, and thus the addition amount thereof may be limited as described above.

The non-oriented electrical steel sheet according to the embodiment of the present invention may further include C at 0.004 wt % or less, N at 0.003 wt % or less, and Ti at 0.003 wt % or less.

C at 0.004 wt % or less

When a large amount of carbon (C) is added, it increases an austenite region to increase a phase transformation period, but during annealing, it may suppress the ferrite grain growth to increase the iron loss. In addition, since it combines with Ti to form a carbide to degrade magnetism, and increases the iron loss by magnetic aging when used after processing from the final product to an electrical product, when C is further contained, it is limited to 0.004 wt % or less.

N at 0.003 wt % or less

Nitrogen (N) is an element undesirable to magnetism by strongly bonding with Al, Ti, etc. to form a nitride to suppress grain growth, so it is preferable to contain less nitrogen (N). When N is further contained, it is limited to 0.003 wt % or less.

Ti at 0.003 wt % or less

Titanium (Ti) suppresses grain growth by forming fine carbides and nitrides, and as it is further added, the texture is deteriorated due to the increased carbides and nitrides, resulting in poor magnetism. In the case of further including Ti, it is limited to 0.003 wt % or less.

Other Impurities

In addition to the above-described elements, impurities that are inevitably mixed may be included. The balance is iron (Fe), and when additional elements other than the above-described elements are added, the balance of iron (Fe) is replaced and included.

The impurities that are inevitably added may be Cu, Ni, Cr, Zr, Mo, V, and the like.

One or more of Cu, Ni, and Cr may be contained in an amount of 0.05 wt % or less, respectively. Cu, Ni, and Cr react with impurity elements to form fine sulfides, carbides and nitrides to undesirably affect magnetism, so contents thereof are limited to 0.05 wt % or less, respectively.

In addition, one or more of Zr, Mo, and V may be further contained in an amount of 0.01 wt % or less, respectively. Since Zr, Mo, V, etc. are also elements strongly forming a carbonitride, it is preferable that they are not added as much as possible, and they are contained in an amount of 0.01 wt % or less, respectively.

The non-oriented electrical steel sheet according to the embodiment of the present invention may include 0.0001 to 0.003 area % of an As precipitate.

In the non-oriented electrical steel sheet according to the embodiment of the present invention, an average particle diameter of of the As precipitate may be 3 to 100 nm.

By properly precipitating the As precipitate, the grain growth is not hindered because Al is not finely precipitated at the grain boundaries. Ultimately, it may improve the magnetism of the non-oriented electric steel sheet.

The non-oriented electrical steel sheet according to the embodiment of the present invention may include 0.0002 to 0.005 area % of a MgS precipitate.

An average particle diameter of the MgS precipitate may be 3 to 30 nm.

An average grain size (or diameter) in the microstructure of the electrical steel sheet may be 60 to 300 μm. When the grain size is too small, the hysteresis loss significantly increases, so that the iron loss worsens. In addition, it is desirable to have an appropriate grain size in order to improve the magnetic flux density by the effect of fine precipitate and segregation. However, when the grain size is too large, there may be a problem in processing during punching in the coated product after annealing. More specifically, the average grain size may be 90 to 200 μm.

The grains for forming the non-oriented electrical steel sheet consist of a structure in which a non-recrystallized structure processed in the cold-rolling process is recrystallized in the final annealing process, and the recrystallized structure is 99 vol % or more.

As described above, the non-oriented electrical steel sheet according to the embodiment of the present invention has excellent magnetism. Particularly, in the low magnetic field region, the iron loss is low and the magnetic flux density is high.

Specifically, a magnetic flux density ($B_{50}$) induced in a magnetic field of 5000 A/m is 1.7 T or more. More specifically, the magnetic flux density ($B_{50}$) is 1.73 to 1.85 T.

As described above, the non-oriented electrical steel sheet according to the embodiment of the present invention has low iron loss in the low magnetic field region. Specifically, the iron loss ($W_{13/50}$) when inducing a magnetic flux density of 1.3 T with a frequency of 50 Hz may be 1.5 W/kg or less. More specifically, the iron loss ($W_{13/50}$) may be 1.3 to 1.47 W/kg. When measuring iron loss, a thickness standard is 0.35 mm. As described above, the non-oriented electrical steel sheet according to the embodiment of the present invention provides optimized characteristics to an inverter-driven AC motor. That is, the non-oriented electrical steel sheet according to the embodiment of the present invention may be used for an AC motor.

The non-oriented electrical steel sheet according to the embodiment of the present invention is excellent not only the iron loss in the low magnetic field region but also in general iron loss. Specifically, the iron loss ($W_{15/50}$) when inducing a magnetic flux density of 1.5 T with a frequency of 50 Hz may be 2.3 W/kg or less. More specifically, the iron loss ($W_{15/50}$) may be 1.5 to 2.15 W/kg.

A manufacturing method of a non-oriented electrical steel sheet according to an embodiment of the present invention includes: heating a slab containing Si at 1.5 to 4.0 wt %, Al at 0.001 to 0.011 wt %, Mn at 0.05 to 0.40 wt %, S at 0.0001 to 0.01 wt %, As at 0.003 to 0.015 wt %, Mg at 0.0007 to 0.003 wt %, and the balance containing Fe and inevitable impurities; hot-rolling the slab to manufacture a hot-rolled sheet; cold-rolling the hot-rolled sheet to manufacture a cold-rolled sheet; and final annealing the cold-rolled sheet.

Hereinafter, respective steps will be specifically described.

First, the slab is heated. The reason for limiting the addition ratio of each composition in the slab is the same as the reason for limiting the composition of the non-oriented electrical steel sheet described above, so a repeated description will be omitted. Since the slab composition is not substantially changed during manufacturing processes including hot-rolling, hot-rolled sheet annealing, cold-rolling, and final annealing to be described later, the composition of the slab and the composition of the non-oriented electrical steel sheet are substantially the same.

The slab is fed into a furnace and heated at 1100 to 1250° C. When heated at a temperature exceeding 1250° C., precipitates of AlN and MnS existing in the slab are re-dissolved and then finely precipitated during hot-rolling, so that grain growth may be suppressed and magnetism may be degraded.

When the slab is heated, hot-rolling is performed to 2.0 to 2.3 mm, and the hot-rolled sheet is wound. During the hot-rolling, the finish rolling in strip milling ends in the ferrite phase area. In addition, during the hot-rolling, a large amount of ferrite-phase expansion elements such as Si, Al, and P may be added, or Mn and C, which are elements that suppress the ferrite phase, may be contained less. As described above, when rolling on the ferrite phase, many {100} planes are formed in the texture, and accordingly, magnetism may be improved.

After the manufacturing of the hot-rolled sheet, hot-rolled-sheet-annealing the hot-rolled sheet may be further included. In this case, a temperature of the hot-rolled-sheet-annealing may be 950 to 1200° C. When the temperature of the hot-rolled sheet annealing is too low, there is little effect of increasing the magnetic flux density because the structure does not grow, or finely grows, and when the temperature of the annealing is too high, magnetic properties are rather deteriorated, and rolling workability may be deteriorated due to deformation of a shape of the sheet. The hot-rolled sheet annealing is performed in order to increase the orientation favorable to magnetism as required, and it may be omitted.

Next, the hot-rolled sheet is pickled and then cold-rolled to have a predetermined sheet thickness. Although It can be applied differently depending on the thickness of the hot-rolled sheet, but cold-rolling may be performed so that the final thickness thereof becomes 0.2 to 0.65 mm, by applying a reduction ratio of 50 to 95%. The cold-rolling may be performed by one cold-rolling or, if necessary, by two or more cold-rollings with intermediate annealing interposed therebetween.

The cold-rolled cold-rolled sheet is subjected to the final annealing (cold-rolled sheet annealing). In the final annealing process of the cold-rolled sheet, the cracking temperature during the annealing is 950 to 1150° C.

When the cold-rolled sheet annealing temperature is too low, it may be difficult to obtain grains of sufficient size to obtain low iron loss. When the annealing temperature is too high, the plate shape during the annealing is uneven, and the precipitates are re-dissolved at a high temperature and then finely precipitated during cooling to be able to adversely affect the magnetism.

The final annealed steel sheet may be treated with an insulating coating. The method of forming the insulating layer is widely known in the field of non-oriented electrical steel sheet technology, so a detailed description thereof is omitted. Specifically, as a composition for forming the insulating layer, either a chromium-type or a chromium-free type may be used without limitation.

Hereinafter, preferred examples of the present invention and comparative examples will be described. However, the following examples are only preferred examples of the present invention, and the present invention is not limited to the following examples.

Example 1

In wt %, a slab containing the following Table 1 and Table 2 and the balance Fe and other inevitable impurities was prepared. The slab was reheated at 1150° C., and then hot-rolled in 2.5 mm to manufacture a hot-rolled sheet. Each manufactured hot-rolled sheet was wound at 650° C., cooled in air, and then subjected to hot-rolled sheet annealing at 1100° C. for 3 minutes. Subsequently, after pickling the hot-rolled sheet, cold-rolling was performed to have a thickness of 0.35 mm. The cold-rolled sheet was subjected to the final annealing at 1050° C. for 1 minute.

The magnetism and microstructure characteristics were analyzed to be summarized in Table 3 below. The precipitate density was measured by using a transmission electron microscope replication method, and the magnetic flux density ($B_{50}$) and the iron loss ($W_{13/50}$, $W_{15/50}$) were measured in the rolling direction and the rolling perpendicular direction using a single plate measurer having a size of 60×60 $mm^2$, and were obtained by an average; and the average grain size was determined by obtaining the average grain area from an optical microscope photograph to take the square root.

TABLE 1

| Specimen (wt %) | Si | Al | Mn | C | N | S | Ti | P | Sn | As | Mg |
|---|---|---|---|---|---|---|---|---|---|---|---|
| A1 | 2.53 | 0.0011 | 0.13 | 0.001 | 0.0028 | 0.0039 | 0.002 | 0.035 | 0.05 | 0.0066 | 0.0009 |
| A2 | 2.18 | 0.002 | 0.13 | 0.001 | 0.0027 | 0.003 | 0.002 | 0.035 | 0.05 | 0.0051 | 0.0009 |
| A3 | 3.17 | 0.003 | 0.13 | 0.001 | 0.0028 | 0.0005 | 0.002 | 0.035 | 0.05 | 0.0034 | 0.0013 |
| A4 | 2.76 | 0.004 | 0.13 | 0.001 | 0.0029 | 0.0044 | 0.002 | 0.035 | 0.05 | 0.0084 | 0.0021 |
| A5 | 2.42 | 0.003 | 0.08 | 0.001 | 0.0028 | 0.0036 | 0.002 | 0.035 | 0.05 | 0.0061 | 0.002 |
| A6 | 2.44 | 0.006 | 0.19 | 0.0035 | 0.0029 | 0.0037 | 0.002 | 0.035 | 0.05 | 0.0062 | 0.0026 |
| A7 | 2.42 | 0.003 | 0.06 | 0.001 | 0.0029 | 0.0036 | 0.002 | 0.035 | 0.05 | 0.0061 | 0.0011 |
| A8 | 2.81 | 0.002 | 0.26 | 0.001 | 0.0029 | 0.0046 | 0.002 | 0.035 | 0.05 | 0.004 | 0.002 |
| A9 | 1.96 | 0.003 | 0.149 | 0.001 | 0.0029 | 0.0025 | 0.002 | 0.035 | 0.05 | 0.0041 | 0.0013 |
| A10 | 2.73 | 0.003 | 0.149 | 0.001 | 0.003 | 0.0044 | 0.002 | 0.035 | 0.05 | 0.0073 | 0.0024 |
| A11 | 3.1 | 0.008 | 0.24 | 0.001 | 0.0025 | 0.0028 | 0.001 | 0.02 | 0.03 | 0.002 | 0.0012 |
| A12 | 2.08 | 0.012 | 0.06 | 0.001 | 0.0028 | 0.0028 | 0.002 | 0.035 | 0.05 | 0.0147 | 0.0034 |
| A13 | 1.74 | 0.005 | 0.021 | 0.001 | 0.0028 | 0.0019 | 0.002 | 0.035 | 0.05 | 0.0069 | 0.0005 |
| A14 | 2.27 | 0.002 | 0.14 | 0.001 | 0.0028 | 0.0032 | 0.002 | 0.035 | 0.05 | 0.0055 | 0.0005 |
| A15 | 2.16 | 0.002 | 0.51 | 0.0065 | 0.0029 | 0.0029 | 0.002 | 0.035 | 0.05 | 0.005 | 0.0025 |
| A16 | 2.11 | 0.002 | 0.135 | 0.006 | 0.0028 | 0.011 | 0.002 | 0.035 | 0.05 | 0.0048 | 0.0005 |
| A17 | 1.73 | 0.005 | 0.147 | 0.001 | 0.005 | 0.0043 | 0.002 | 0 | 0.05 | 0.0067 | 0.0005 |
| A18 | 2.62 | 0.003 | 0.148 | 0.001 | 0.0028 | 0.0007 | 0.002 | 0.02 | 0 | 0.007 | 0.0005 |
| A19 | 2.36 | 0.002 | 0.147 | 0.003 | 0.0029 | 0.0066 | 0.014 | 0.035 | 0.05 | 0.0059 | 0.008 |
| A20 | 2.7 | 0.011 | 0.139 | 0.001 | 0.0029 | 0.0018 | 0.002 | 0.035 | 0.05 | 0.004 | 0.0005 |

TABLE 2

| Specimen | [As] > [Al] | 3 × [Mg] > [Al] | [Sn] + [P] | Sb | Cr | Mo | V | Ca |
|---|---|---|---|---|---|---|---|---|
| A1 | ○ | ○ | 0.085 | 0.001 | 0.001 | 0.0005 | 0.005 | 0.002 |
| A2 | ○ | ○ | 0.085 | 0.001 | 0.001 | 0.0005 | 0.005 | 0.001 |
| A3 | ○ | ○ | 0.085 | 0.001 | 0.001 | 0.0005 | 0.005 | 0 |
| A4 | ○ | ○ | 0.085 | 0.001 | 0.001 | 0.0005 | 0.005 | 0.002 |
| A5 | ○ | ○ | 0.085 | 0.001 | 0.001 | 0.0005 | 0.005 | 0.002 |
| A6 | ○ | ○ | 0.085 | 0.001 | 0.001 | 0.0005 | 0.005 | 0.002 |
| A7 | ○ | ○ | 0.085 | 0.001 | 0.001 | 0.0005 | 0.005 | 0.002 |
| A8 | ○ | ○ | 0.085 | 0.001 | 0.001 | 0.0005 | 0.005 | 0.002 |

TABLE 2-continued

| Specimen | [As] > [Al] | 3 × [Mg] > [Al] | [Sn] + [P] | Sb | Cr | Mo | V | Ca |
|---|---|---|---|---|---|---|---|---|
| A9 | ○ | ○ | 0.085 | 0.001 | 0.001 | 0.0005 | 0.005 | 0.001 |
| A10 | ○ | ○ | 0.085 | 0.001 | 0.001 | 0.0005 | 0.005 | 0.002 |
| A11 | X | X | 0.05 | 0.001 | 0.001 | 0.0005 | 0.005 | 0.002 |
| A12 | ○ | X | 0.085 | 0.001 | 0.001 | 0.0005 | 0.005 | 0.001 |
| A13 | ○ | X | 0.085 | 0.001 | 0.001 | 0.0005 | 0.005 | 0.001 |
| A14 | ○ | X | 0.085 | 0.001 | 0.001 | 0.0005 | 0.005 | 0.001 |
| A15 | ○ | ○ | 0.085 | 0.001 | 0.001 | 0.0005 | 0.005 | 0.001 |
| A16 | ○ | X | 0.085 | 0.012 | 0.001 | 0.0005 | 0.005 | 0.001 |
| A17 | ○ | X | 0.05 | 0.001 | 0.0013 | 0.0005 | 0.005 | 0.001 |
| A18 | ○ | X | 0.02 | 0.001 | 0.001 | 0.01 | 0.005 | 0.002 |
| A19 | ○ | ○ | 0.085 | 0.001 | 0.001 | 0.0005 | 0.005 | 0.001 |
| A20 | X | X | 0.085 | 0.001 | 0.001 | 0.0005 | 0.013 | 0.002 |

TABLE 3

| Specimen | As precipitate particle diameter (nm) | MgS precipitate particle diameter (nm) | MgS precipitate fraction (%) | $W_{13/50}$ (W/kg) | $W_{15/50}$ (W/kg) | $B_{50}$ (T) | Grain size (μm) | Remarks |
|---|---|---|---|---|---|---|---|---|
| A1 | 41.5 | 8 | 0.002 | 1.47 | 1.98 | 1.77 | 143 | Inventive Example |
| A2 | 32 | 6.9 | 0.0015 | 1.42 | 1.97 | 1.81 | 164 | Inventive Example |
| A3 | 9.6 | 4 | 0.0003 | 1.47 | 2.03 | 1.73 | 140 | Inventive Example |
| A4 | 50.6 | 16 | 0.0046 | 1.46 | 2.01 | 1.78 | 144 | Inventive Example |
| A5 | 38.3 | 13.2 | 0.0043 | 1.45 | 1.95 | 1.79 | 152 | Inventive Example |
| A6 | 39.1 | 16.6 | 0.0048 | 1.44 | 2.03 | 1.8 | 156 | Inventive Example |
| A7 | 38.3 | 8.6 | 0.0023 | 1.45 | 2.01 | 1.79 | 152 | Inventive Example |
| A8 | 34 | 16 | 0.0046 | 1.5 | 2.11 | 1.75 | 95 | Inventive Example |
| A9 | 26.1 | 7.7 | 0.0019 | 1.39 | 1.71 | 1.83 | 179 | Inventive Example |
| A10 | 46.2 | 17.9 | 0.0034 | 1.49 | 1.84 | 1.75 | 134 | Inventive Example |
| A11 | 31.9 | 40.1 | <0.0001 | 1.52 | 2.31 | 1.67 | 67 | Comparative example |
| A12 | 125 | 42.047 | 0.0001 | 1.6 | 2.53 | 1.65 | 58 | Comparative example |
| A13 | 62.9 | 35.9 | <0.0001 | 1.58 | 2.47 | 1.63 | 55 | Comparative example |
| A14 | 62.1 | 39.1 | <0.0001 | 1.6 | 2.39 | 1.63 | 50 | Comparative example |
| A15 | 56.4 | 47.5 | 0.0057 | 1.54 | 2.48 | 1.68 | 65 | Comparative example |
| A16 | 112.9 | 44 | 0.0062 | 2.3 | 3.12 | 1.66 | 34 | Comparative example |
| A17 | 78.6 | 35.6 | <0.0001 | 1.62 | 2.55 | 1.61 | 58 | Comparative example |
| A18 | 55 | 43.7 | <0.0001 | 1.54 | 2.44 | 1.69 | 55 | Comparative example |
| A19 | 89.3 | 128.6 | 0.0127 | 1.55 | 2.49 | 1.67 | 58 | Comparative example |
| A20 | 41.4 | 41.1 | <0.0001 | 1.57 | 2.43 | 1.67 | 54 | Comparative example |

As shown in Table 1 to Table 3, it can be confirmed that the inventive examples in which the contents of As and Mg are controlled have excellent magnetism, and particularly, excellent iron loss ($W_{13/50}$) in the low magnetic field region.

On the other hand, it can be confirmed that when the contents of As and Mg are not satisfied, the magnetism characteristic is relatively deteriorated.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described exemplary embodiments are for illustrative purposes only, and the scope of the present invention is not limited thereto.

The invention claimed is:

1. A non-oriented electrical steel sheet, comprising: Si at 1.5 to 4.0 wt %, Al at 0.001 to 0.011 wt %, Mn at 0.05 to 0.40 wt %, S at 0.0001 to 0.01 wt %, As at 0.0034 to 0.01 wt %, Mg at 0.0009 to 0.002 wt %, and the balance including Fe and other impurities unavoidably added thereto, wherein the non-oriented electrical steel sheet satisfies Formulas 1 and 2:

$$[As]>[Al], \text{ and} \quad \text{Formula 1}$$

$$3\times[Mg]>[Al], \quad \text{Formula 2}$$

wherein [As], [Mg] and [Al] are contents (wt %) of As, Mg and Al, respectively, wherein an average particle diameter of the precipitate of As is 3 to 100 nm, wherein an average particle diameter of the precipitate of MgS is 3 to 30 nm, wherein iron loss ($W_{15/50}$) of the non-oriented electrical steel sheet is 1.5 to 2.15 W/kg, and wherein iron loss ($W_{13/50}$) of the non-oriented electrical steel sheet is 1.3 to 1.47 W/kg.

2. The non-oriented electrical steel sheet of claim 1, further comprising Sn at 0.02 to 0.09 wt % and Pat 0.01 to 0.15 wt %.

3. The non-oriented electrical steel sheet of claim 2, wherein the non-oriented electrical steel sheet satisfies Formula 3:

$$0.03\leq[Sn]+[P]\leq0.15 \quad \text{[Formula 3]}$$

(in Formula 3, [Sn] and [P] are contents (wt %) of Sn and P, respectively).

4. The non-oriented electrical steel sheet of claim 1, further comprising C at 0.004 wt % or less, Nat 0.003 wt % or less, and Ti at 0.003 wt % or less.

5. The non-oriented electrical steel sheet of claim 1, wherein one or more of Cu, Ni, and Cr are further contained in an amount of 0.05 wt % or less, respectively.

6. The non-oriented electrical steel sheet of claim 1, wherein one or more of Zr, Mo, and V are further contained in an amount of 0.01 wt % or less, respectively.

7. The non-oriented electrical steel sheet of claim 1, wherein a precipitate of As is included at a size of 0.0001 to 0.003 area %.

8. The non-oriented electrical steel sheet of claim 1, wherein a precipitate of MgS is included at a size of 0.0002 to 0.005 area %.

9. The non-oriented electrical steel sheet of claim 1, wherein an average grain size is 60 to 300 μm.

* * * * *